United States Patent [19]

Allegre

[11] Patent Number: 4,792,983

[45] Date of Patent: Dec. 20, 1988

[54] BAG OR LIKE PACKING HAVING AND INVIOLABLE CLOSURE

[75] Inventor: André Allegre, Dardilly, France

[73] Assignee: Decomatic S.A.

[21] Appl. No.: 76,438

[22] Filed: Jul. 22, 1987

[30] Foreign Application Priority Data

Jul. 22, 1986 [FR] France ..... 86 10612

[51] Int. Cl.[4] ..... B65D 33/25

[52] U.S. Cl. ..... 383/13; 383/5; 383/15; 383/63; 383/93

[58] Field of Search ..... 383/5, 63, 64, 65, 29, 383/13, 15, 93; 206/807; 24/587

[56] References Cited

U.S. PATENT DOCUMENTS

| | | | |
|---|---|---|---|
| 1,991,943 | 2/1935 | Keviczky | 383/63 |
| 2,039,887 | 5/1936 | Colletti | 383/63 |
| 2,046,127 | 6/1936 | Massini | 206/807 |
| 2,520,467 | 8/1950 | Merralls | 383/63 |
| 3,529,317 | 9/1970 | Schwarzkopf | 383/15 |
| 4,175,604 | 11/1979 | Bonner | 383/5 |

FOREIGN PATENT DOCUMENTS

| | | | |
|---|---|---|---|
| 1140723 | 8/1957 | France | 24/587 |
| 1247945 | 10/1960 | France | 383/63 |

*Primary Examiner*—Stephen P. Garbe

*Attorney, Agent, or Firm*—Larson and Taylor

[57] ABSTRACT

The bag comprises, respectively fixed by welding to the two inner edge portions of the opening (3) of the bag and substantially throughout the length of the opening, two bars (4, 5) of plastics material having complementary sections (7, 8, 9, 10) capable of interpenetration upon application of a force for preventing opening of the bag by manual force.

8 Claims, 1 Drawing Sheet

Fig: 1
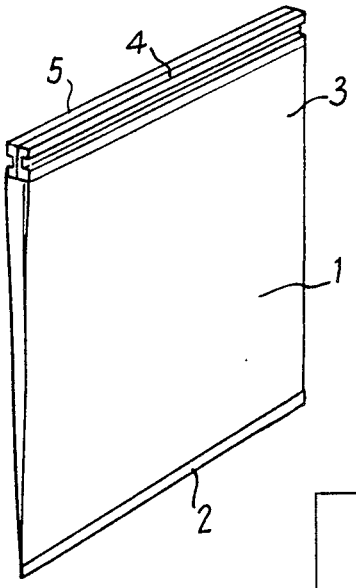
Fig: 4
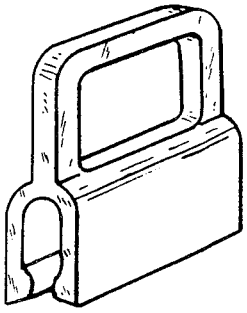
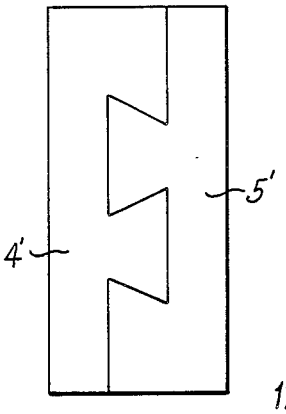
Fig: 5
Fig: 2
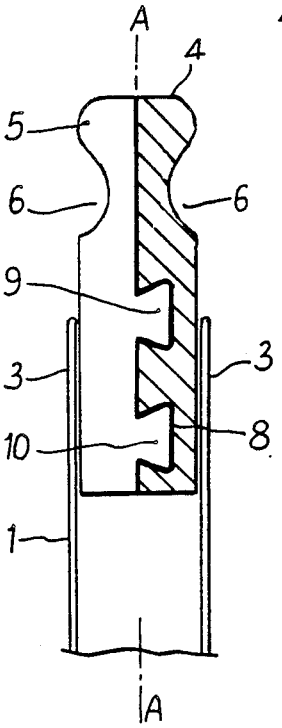
Fig: 3
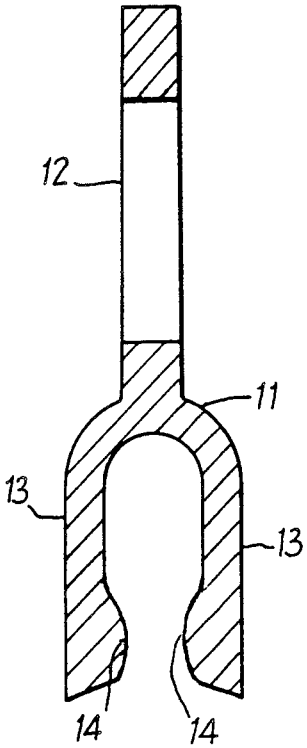

BAG OR LIKE PACKING HAVING AND INVIOLABLE CLOSURE

The present invention relates to a bag of flexible plastics or like material or packing of this type having an inviolable closure.

Bags of flexible plastics material provided with closing means usually have either two handles each constituted by a loop and a small bar provided with pressure-actuated closing elements, such as lugs and apertures, or a sliding fastener of plastics material with or without the slider, or a flap having a part rendered adhesive. These bags may of course be opened or closed at will.

Now, in vending areas, one of the problems which has been insufficiently solved up to the present time is that of protection against theft, since a bag made available for a purchase may be used for hiding other objects stolen from other counters.

Several means have already been provided to overcome this drawback, such as the use of adhesive bands or closure by stapling. However, these solutions are not very satisfactory and are moreover inaesthetic.

Another solution could consist in thermowelding the opening of the bag, but this requires the use of a delicate apparatus which is not easy to employ at any location in a large vending area. Further, the thermowelding of the opening of the bag is practically impossible in the case of bags having handles and in particular handles moulded from plastics material formed by a loop and a small bar.

An object of the present invention is to oveccome these drawbacks and to provide a bag of flexible plastics material having an inviolable closure which is simple, cheap, has an impeccable appearance and ensures a perfect closure while allowing the presence of a handle or even facilitating the mounting of the latter. Another object of the invention is to provide bags or like packings which may serve to display articles on a counter of a store, these bags or packings being suspended from a rod.

The invention provides a bag or like packing of flexible material having an inviolable closure, said bag further comprising, respectively fixed, in particular by welding or adhesion, on the two inner edges of the opening of the bag and substantially throughout the length of said opening, two small bars of plastics material having complementary sections capable of interpenetrating upon application of force for an inviolable assembly of one bar against the other by the application of pressure.

Interpenetration by application of force in the sense of the present invention is intended to mean such interpenetration which does not allow a separation of the two assembled sections by a simple manual effort.

Preferably, the complementary sections of the bars are of the dovetail type. The dimensions of the complementary respective parts, and their shapes, ae so arranged that, after assembly, the effort required to separate them exceeds a manual force.

The sections of the bars may be identical, in which case each of the bars has a male section part and a female section part, one of the bars being inverted with respect to the other.

In another embodiment, the sections of the bars may be different, one having for example one or more male section parts and the other one or more corresponding female section parts, preferably of the dovetail type.

Advantageously, the bars may be provided with means for forming a handle. Thus it may be envisaged to mould the bars with loops forming handles in a single piece.

However, it is preferable to realize the bars without handles and to provide thereon section parts in the form of grooves or ribs for the hooking of a separate handle. In a particularly preferred arrangement, each bar may be provided in its upper part, and on the outer side, i.e. on the side remote from the other bar, with a groove for receiving corresponding hooking projections of a fork connected to a handle.

The bars may thus be produced for example by extrusion instead of having to be injected.

The bag carrying the bars may be of any conventional type of flexible plastics material.

The bag may also form a packing adapted to display an article and, in this case, it may be made from a transparent plastics sleeve or by the assembly of two films, one being opaque and the other transparent. In this case, the bars may be advantageously provided with transverse apertures permitting the hooking of the display bag on a display rod.

Further features and advantages of the invention will be apparent from the following description which is given by way of a non-limiting example with reference to the accompanying drawing, in which:

FIG. 1 is a perspective view of the bag according to the invention;

FIG. 2 is a cross-sectional view of the bag closed in the region of the bars;

FIG. 3 is a cross-sectional view of a handle adapted to be mounted;

FIG. 4 is a perspective view of the handle, and

FIG. 5 is a cross-sectional view of a further embodiment of the closure of the invention which employs identical bars.

The bag according to the invention is made in the conventional manner from a sleeve of flexible plastics material 1 which is suitably flattened and cut in such manner as to form the bag 1 proper, the bottom 2 being formed by a weld line close to the cut whereas the opening remains free.

Welded to the interior of the two longitudinal edge portions 3 of the opening are two small bars 4, 5 formed by two sections of an extruded section member having the shape shown in FIG. 2. In its upper part, the outer side of each bar has a groove 6 located at the level of the upper part of the bars which extends beyond the edge portions 3 of the bag 1. These grooves serve to fix a handle.

The groove 6 may have a partly or completely dovetailed shape. However, a concave shape is preferred, as shown in the drawing, which does not permit hooking into the groove an element which may serve to exert a force for separating the bars in a direction perpendicular to the plane A—A of the bag.

The rest of the outer sides of the bars is planar and permits the welding or the adhesion of the respective bars against the inner surfaces of the edge portions 3 of the bag 1.

The inner sides of the bars 4, 5 have complementary sections, namely two dovetail grooves 7, 8 for the bars 4 and two ribs 9, 10 of complementary shapes for the bar 5.

The bars 4, 5 are preferably deformable and not rigid in order to facilitate the introduction of an article into the bag.

In use, the two bars welded in the opening of the bag are spread apart; the bag is thus opened and permits the introduction of the article or articles to be wrapped.

Thereafter, the two bars 4, 5 are applied against each other with great force, preferably by means of a mechanical pressure created for example by mechanical equipment consisting of two wheels pivoting about two pins parallel to the junction plane A—A of the bars, so that the ribs 9, 10 are forced into their respective grooves 7, 8. This requires a rather large deformation of the plastics material, the assembly being sufficiently tight to ensure that no manual separating effort can separate the bars 4, 5, the closure being thus inviolable.

It will be understood that the complementary shapes of the closing sections 7, 8, 9, 10 may be different. For example, a single groove 7 may be employed with a single rib 9 or, on the contrary, more than two assemblies of grooves and ribs could be used. Further, as shown in FIG. 5, the cross sections of the bars 4', 5' can be identical, with bar 4' being inverted with respect to bar 5' so that the bars fit together.

The bag may receive an injection moulded handle 11 having a handle loop 12 and a transverse fork whose branches 13 are made to surround the assembly of the bars 4, 5 in the region of their upper part, the ends of the branches 13 of the fork having inner projections 14 complementary to the shapes of the grooves 6 so that it is sufficient to insert the ends 14 into the grooves 6 to hook the handle to the assembly consisting of the two bars 4, 5.

Although the invention has been described in respect of a particular embodiment, it must be understood that the scope of the invention is in no way limited thereto and that various modifications as concerns shapes or material may be made therein without departing from the scope or spirit of the invention.

What is claimed is:

1. A bar or like packing of flexible material, in particular a plastics material, said bag comprising an opening having inner edge portions and a closure means for the bag for preventing opening of the bag by manual force, said closure means comprising, respectively fixed to the two inner edge portions of the opening of the bag and substantially throughout the length of said opening, two bars of plastics material having complementary sections capable of mutual interpenetration responsive to the application of force so as to produce an assembly wherein the bars act one against the other to prevent separation thereof by the application of manual force.

2. A bag or like packing according to claim 1, wherein the bars are welded in the opening of the bag.

3. A bag or like packing according to claim 1, wherein the complementary sections of the bars are of a substantially dovetail type.

4. A bag or like packing according to claim 1, wherein the sections of the bars are identical, one of the bars being inverted with respect to the other.

5. A bag or like packing according to claim 1, wherein the bars are different from each other, one of the bars having at least one male section part and the other at least one female section part.

6. A bag or like packing according to claim 1, wherein the bars are provided with means for supporting a handle.

7. A bag or like packing according to claim 6, further comprising a handle mounted on the bars.

8. A bag or like packing according to claim 7, wherein the handle has a portion in the shape of a fork having branches and hooking projections which terminate said branches, hooking grooves being provided in the bars with which grooves said hooking projections cooperate.

* * * * *